US005670249A

United States Patent [19]

Tanuma

[11] Patent Number: 5,670,249

[45] Date of Patent: Sep. 23, 1997

[54] RECORDING SHEET AND RECORD

[75] Inventor: Toshihiro Tanuma, Yokohoma, Japan

[73] Assignee: Asahi Glass Company Ltd., Tokyo, Japan

[21] Appl. No.: 728,190

[22] Filed: Oct. 10, 1996

Related U.S. Application Data

[63] Continuation of Ser. No. 448,896, May 24, 1995, abandoned.

[30] Foreign Application Priority Data

May 25, 1994 [JP] Japan ..... 6-111278
Jul. 21, 1994 [JP] Japan ..... 6-169677

[51] Int. Cl.[6] ..... B41J 2/01; B41M 5/00

[52] U.S. Cl. ..... 428/304.4; 428/195; 428/328

[58] Field of Search ..... 428/195, 304.4, 428/328

[56] References Cited

U.S. PATENT DOCUMENTS 5,104,730 4/1992 Misuda et al. .
5,202,205 4/1993 Malhotra ..... 428/330
5,437,925 8/1995 Macauley et al. ..... 428/331
5,451,466 9/1995 Malhotra ..... 428/195

FOREIGN PATENT DOCUMENTS 0 586 846 3/1994 European Pat. Off. .
57-135 166 8/1982 Japan .
60-152575 8/1985 Japan .

OTHER PUBLICATIONS

Database WPI, Derwent Publications, AN 91–063234, with JP–A–3 13376, Jan. 22, 1991.
Database WPI, Derwent Publications, AN 84–228076, with JP–A–59 135187, Aug. 3, 1984.
Database WPI, Derwent Publications, AN 95–144364, JP–A–7 068 919, Mar. 14, 1995.

*Primary Examiner*—Pamela R. Schwartz
*Attorney, Agent, or Firm*—Oblon, Spivak, McClelland, Maier & Neustadt, P.C.

[57] ABSTRACT

A recording sheet which comprises a substrate and a porous ink-receiving layer containing at least one compound selected from the group consisting of dithiocarbamates, thiurams, thiocyanate esters, thiocyanates and hindered amines, formed on the substrate.

20 Claims, No Drawings

RECORDING SHEET AND RECORD

This application is a Continuation of application Ser. No. 08/448,896, filed on May 24, 1995, now abandoned.

The present invention relates to a recording sheet and a record.

It has become common to use various printers of e.g. ink jet system, electrostatic transfer system or sublimation type thermal transfer system to form images. In such cases, with normal papers, no adequate absorptivity or resolution may be obtained, and transparent products are not available. Therefore, a recording sheet has been proposed in which an inorganic porous layer is formed on a substrate, for example, in U.S. Pat. No. 5,104,730.

Such a recording sheet having an inorganic porous layer is excellent in the ink absorptivity and also in the property for fixing colorants. However, such a recording sheet having an inorganic porous layer has a drawback that during the storage after printing, images on the sheets tend to fade.

Accordingly, it is an object of the present invention to provide a recording sheet which is excellent in the ink absorptivity and also in the property for fixing a colorant and which is free from color-fading of images during the storage after printing for a long period of time.

The present invention provides a recording sheet which comprises a substrate and a porous ink-receiving layer containing at least one compound selected from the group consisting of dithiocarbamates, thiurams, thiocyanate esters, thiocyanates and hindered amines, formed on the substrate.

Further, the present invention provides a record which comprises a substrate and a porous ink-receiving layer containing at least one compound selected from the group consisting of dithiocarbamates, thiurams, thiocyanate esters, thiocyanates and hindered amines, formed on the substrate, wherein a colorant is supported in the porous ink-receiving layer.

Now, the present invention will be described in detail with reference to the preferred embodiments.

The thiocarbamates, thiurams, thiocyanate esters, thiocyanates and hindered amines function as anti-fading agents, whereby color-fading of ink during the storage after printing can be prevented. The mechanism of such anti-fading agents are not clearly understood, but it is considered that they stabilize other additives or prevent color-fading due to trace amounts of gases in the atmosphere.

These dithiocarbamates, thiurams, thiocyanate esters, thiocyanates and hindered amines may be used alone respectively to present excellent anti-fading effects. However, when these compounds are used in combination as a mixture or two or more, more excellent effects can be obtained. Further, when such compounds are used in combination with a quencher made of iodine or an iodide, further increased anti-fading effects can be obtained, and it is possible to prevent the recording sheet from being colored by iodine of the quencher. Here, the quencher is a substance which reacts with active singlet oxygen formed in the presence of oxygen, to deactivate it.

The recording sheet of the present invention is useful particularly as a recording medium for ink jet printers. The recording sheet of the present invention is excellent particularly in the ink absorptivity and the colorant-fixing property, whereby a clear color can be formed with high color density, and sharp dots can be formed.

As the dithiocarbamates to be used as anticolor fading agents, potassium dimethyl dithiocarbamate and sodium diethyl dithiocarbamate may, for example, be preferably employed. As the thiurams, tetraethylthiuram disulfide and tetramethylthiuram monosulfide may, for example, be preferably employed. As the thiocyanate esters, methyl thiocyanate and ethyl thiocyanate may, for example, be preferably employed. As the thiocyanates, sodium thiocyanate and potassium thiocyanate may, for example, be preferably employed. Among the above compounds, thiocyanates are particularly preferred, since they have high anti-fading effect and they can easily be incorporated to the ink-receiving layer.

As the iodide to be used as a quencher, a metal iodide such as potassium iodide or sodium iodide may, for example, be employed.

Further, hindered amines are particularly effective when used in combination with a quencher made of iodine or an iodide.

As a method of incorporating at least one compound (hereinafter referred to as the anti-fading agent) selected from the group consisting of the dithiocarbamates, thiurams, thiocyanate esters, thiocyanates and hindered amines, or a quencher made of iodine or an iodide (hereinafter referred to as the quencher) and the anti-fading agent, to the porous ink-receiving layer, it is preferred to employ a method of applying a solution having the anti-fading agent, or the anti-fading agent and the quencher dissolved in a suitable solvent, to the preliminarily formed porous ink-receiving layer by dipping or spraying method. Otherwise, it is also possible to employ a method wherein the anti-fading agent, or the anti-fading agent and the quencher, are preliminarily mixed to the starting material for forming the porous ink-receiving layer.

The content of the anti-fading agent is preferably from 0.01 to 10 wt %, based on the weight of the porous ink-receiving layer. If the content of the anti-fading agent is less than 0.01 wt %, no adequate effects of the present invention tend to be obtained, and color-fading of ink is likely to occur, such being undesirable. If the content of the anti-fading agent exceeds 10 wt %, the absorptivity of the porous layer is likely to deteriorate, such being undesirable. The content of the anti-fading agent is more preferably from 0.1 to 5 wt %.

The anti-fading agent may be used alone to provide adequate effects. However, when it is used in combination with the quencher, the effects can further be improved. The total content of the anti-fading agent and the quencher is preferably from 0.01 to 10 wt %, based on the weight of the porous ink-receiving layer. If the total content of the anti-fading agent and the quencher is less than 0.01 wt %, no adequate effects of the present invention tend to be obtained, and color-fading of ink is likely to occur, such being undesirable. If the total content of the anti-fading agent and the quencher exceeds 10 wt %, coloring by the quencher itself is likely to be problematic, and the absorptivity of the porous layer is likely to deteriorate, such being undesirable. The total content of the anti-fading agent and the quencher is more preferably from 0.1 to 5 wt %.

In the present invention, the porous ink-receiving layer is an inorganic porous layer capable of absorbing and fixing ink at the time of recording. If the thickness of the porous ink-receiving layer is too thin, the colorant can not adequately be supported, and only an image with low color density may be obtained, such being undesirable. On the other hand, if the thickness is too much, there will be a drawback that the strength of the porous ink-receiving layer tends to deteriorate, or the transparency tends to decrease, whereby the transparency, the color density or the texture of the printed matter tends to be impaired. The thickness of the porous ink-receiving layer is preferably from 1 to 50 μm.

The porous ink-receiving layer preferably has a structure in which inorganic particles are bound by a binder. The material of the inorganic particles may preferably be silica, alumina or a hydrate thereof. Among these materials, pseudoboehmite is particularly preferred. A porous layer made of pseudoboehmite has good absorptivity and is capable of selectively adsorbing a colorant, whereby a clear record with high color density can be obtained by means of various recording systems. Here, the pseudoboehmite is an alumina hydrate represented by the compositional formula of $Al_2O_3.nH_2O$ (n=1~1.5), and the porous layer made of pseudoboehmite is an aggregate having a porous structure.

The pseudoboehmite porous ink-receiving layer is preferably such that the porous structure is composed substantially of pores with radii of from 1 to 15 nm and the pore volume is from 0.3 to 1.0 cc/g, so that it has adequate absorptivity and transparency. When a pseudoboehmite porous ink-receiving layer having a pore structure within such ranges, is used, if the substrate is transparent, it is possible to obtain a transparent record. If the substrate is opaque, it is possible to obtain a record having high color density. Further, it is further preferred that the average pore radius of the pseudoboehmite porous ink-receiving layer is within a range of from 3 to 10 nm. Here, measurement of the pore size distribution is carried out by a nitrogen absorption and desorption method.

To prepare the pseudoboehmite porous ink-receiving layer having the above mentioned porous structure, it is preferred to employ a boehmite sol obtained by hydrolyzing aluminum alkoxides. As a means for coating the pseudoboehmite porous ink-receiving layer on the substrate, it is preferred to employ a method wherein a binder is added to a boehmite sol to obtain a coating liquid, which is then coated on a substrate by means of die coater, a roll coater, an air knife coater, a blade coater, a rod coater or a bar coater, followed by drying.

As the binder to be used for the porous ink-receiving layer, an organic substance such as starch or its modified product, polyvinyl alcohol or its modified product, SBR (butadiene-styrene rubber) latex, NBR (butadiene-acrylonitrile rubber) latex, hydroxycellulose or polyvinyl pyrrolidone may be employed. The amount of the binder is preferably from 5 to 50 wt % of the inorganic particles, since if it is too small, the strength of the porous ink-receiving layer will be inadequate, and on the other hand, if it is too large, the ink absorbing quantity will be low.

In the present invention, as the substrate, various materials may be used. For example, a plastic material, for example, a polyester such as polyethylene terephthalate, a polycarbonate, or a fluorine resin such as ETFE, or paper, may suitably be employed. To such substrates, corona discharge treatment or undercoating may be applied for the purpose of improving the bond strength of the porous ink-receiving layer.

In the present invention, the anti-fading effects can be further improved by adding at least one compound selected from the group consisting of thiourea derivatives, thiosemicarbazide derivatives and thiocarbohydrazide derivatives to the porous ink-receiving layer.

Further, when only an iodine or an iodide is added as a quencher, the recording sheet will be colored by iodine. However, the said at least one compound selected from the group consisting of thiourea derivatives, thiosemicarbazide derivatives and thiocarbohydrazide derivatives is effective also for preventing such coloring.

It is preferred to use the anti-fading agent, the quencher and at least one compound selected from the group consisting of thiourea derivatives, thiosemicarbazide derivatives and thiocarbohydrazide derivatives, in combination, since it is thereby possible to further increase the anti-fading effects.

As the thiourea derivatives, thiourea, N-methyl thiourea, N,N'-dimethyl thiourea and tetramethyl thiourea may, for example, be preferably employed. As the thiosemicarbazide derivatives, thiosemicarbazide, N-methylthiosemicarbazide and N-phenylthiosemicarbazide may, for example, be preferably employed. As the thiocarbohydrazide derivatives, thiocarbohydrazide and N-methyl-N'-butylthiocarbohydrazide may, for example, be preferably employed.

The content of the compound selected from the group consisting of thiourea derivatives, thiosemeicarbazide derivatives and thiocarbohydrazide derivatives is preferably from 0.01 to 10 wt %, based on the weight of the porous ink-receiving layer. More preferably, the content is from 0.1 to 3 wt %. If the total content is less than 0.01 wt %, no adequate effects for preventing fading of color tend to be obtained, such being undesirable. If the total content exceeds 10 wt %, the absorptivity of the porous layer tends to be hindered, such being also undesirable.

Now, the present invention will be described in further detail with reference to Examples. However, it should be understood that the present invention is by no means restricted to such specific Examples.

EXAMPLE 1

Into a glass reactor having a capacity of 2 l, the 540 g of water and 676 g of isopropyl alcohol were charged, and the liquid temperature was raised to 75° C. by a mantle heater. Then, 306 g of aluminum isopropoxide was added thereto with stirring, followed by hydrolysis for 5 hours while maintaining the liquid temperature at a level of from 75° to 78° C. Then, the temperature was raised to 95° C., and 9 g of acetic acid was added thereto. The mixture was maintained at a temperature of from 75° to 78° C. for 48 hours for peptization. Further, this solution was concentrated to 900 g to obtain a white sol. The dried product of this sol was pseudoboehmite.

To 5 parts by weight of this alumina sol, 1 part by weight of polyvinyl alcohol was added. Further, water was added thereto to obtain a coating liquid having a solid content of about 10%. This coating liquid was coated on a substrate made of polyethylene terephthalate (thickness 100 μm) treated with corona discharge treatment, by means of a bar coater so that the dried layer thickness would be 30 μm, followed by drying to form a porous ink-receiving layer of boehmite.

The coated surfaces of such recording sheets thus obtained, were dipped in aqueous solutions or ethanol solutions having various concentrations of the treating agents as identified in Table 1, so that the solutions were uniformly coated thereon. Such recording sheets were vertically suspended and dried in air, and then they were heated at 140° C. for 4 minutes by a drum dryer. In this Example, dithiocarbamates were used as treating agents.

A part of each recording sheet thus obtained was cut out and immersed in an aqueous hydrochloric acid solution for 12 hours, whereupon the solution was subjected to absorptiometry by ultraviolet and visible spectra or to quantitative analysis by ion chromatography to obtain the amount (supported amount) of the treating agent consisting of the anti-fading agent, or the anti-fading agent and the quencher, in the porous ink-receiving layer of the recording sheet.

To the recording sheets of this Example treated as described above, recording was carried out by means of an ink jet printer, whereby the ink absorptivity and the colorant-fixing property were excellent.

Further, black ink containing food black 2 was printed on the recording sheets and exposed in a room for 30 days, whereby fading of the black color was inspected. The results are shown Table 1. For the purpose of the comparison, the color fading was inspected in the same manner also with respect to the recording sheet to which no treatment was applied. The results are also shown as "non-treatment" in Table 1.

TABLE 1

| Treating agent | Concentration of the treating solution | Supported amount | Color fading degree |
|---|---|---|---|
| Non-treatment | 0 | 0 | X |
| Sodium dimethyl dithiocarbamate | 0.1 | 0.05 | ○ |
| | 0.3 | 0.33 | ○ |
| | 1.0 | 1.05 | ○ |
| | 2.0 | 1.83 | ○ |
| Sodium diethyl dithiocarbamate | 0.1 | 0.08 | Δ |
| | 0.3 | 0.28 | ○ |
| | 1.0 | 0.83 | ○ |
| | 2.0 | 1.63 | ○ |
| Potassium dimethyl dithiocarbamate | 0.1 | 0.05 | ○ |
| | 0.3 | 0.33 | ○ |
| | 1.0 | 0.75 | ○ |
| | 2.0 | 1.70 | ○ |
| Zinc dimethyl dithiocarbamate | 0.1 | 0.05 | Δ |
| | 0.3 | 0.33 | ○ |
| | 1.0 | 0.90 | ○ |
| | 2.0 | 1.70 | ○ |

In Table 1, the unit for the concentration of the agent of the treating solution is weight %, and the unit for the supported amount of the treating agent in the recording sheet is wt % based on the weight of the ink receiving layer. The color-fading degree was evaluated by three ratings of x (considerable color-fading), Δ (slight color-fading) and ○ (no color-fading). The color-fading degree of the non-treated sheet was considerable (x). The units for the concentration of the treating solution and the supported amount as well as the evaluation standards for the color-fading degree are the same also in the following Tables 2 and 3.

EXAMPLE 2

To recording sheets each having a porous ink-receiving layer of pseudoboehmite prepared in the same manner as in Example 1, treating solutions having various concentrations of the treating agents as identified in Table 2 were coated in the same manner as in Example 1. In this Example, thiurams were used as treating agents. Evaluation was carried out in the same manner as in Example 1, and the results are shown in Table 2. Further, to the recording sheets of this Example, recording was carried out by means of an ink jet printer, whereby the ink absorptivity and the colorant-fixing property were excellent.

TABLE 2

| Treating agent | Concentration of the treating solution | Supported amount | Color fading degree |
|---|---|---|---|
| Non-treatment | 0 | 0 | X |
| Tetramethyl thiuram | 0.1 | 0.08 | Δ |
| | 0.3 | 0.30 | ○ |

TABLE 2-continued

| Treating agent | Concentration of the treating solution | Supported amount | Color fading degree |
|---|---|---|---|
| disulfide | 1.0 | 1.03 | ○ |
| | 2.0 | 1.63 | ○ |
| Tetraethyl thiuram disulfide | 0.1 | 0.05 | ○ |
| | 0.3 | 0.28 | ○ |
| | 1.0 | 0.88 | ○ |
| | 2.0 | 1.88 | ○ |
| Tetrabutyl thiuram disulfide | 0.1 | 0.08 | Δ |
| | 0.3 | 0.80 | ○ |
| | 1.0 | 0.88 | ○ |
| | 2.0 | 1.73 | ○ |
| Tetramethyl thiuram monosulfide | 0.1 | 0.08 | ○ |
| | 0.3 | 0.35 | ○ |
| | 1.0 | 0.88 | ○ |
| | 2.0 | 1.63 | ○ |
| Tetraethyl thiuram monosulfide | 0.1 | 0.05 | Δ |
| | 0.3 | 0.33 | ○ |
| | 1.0 | 0.80 | ○ |
| | 2.0 | 1.63 | ○ |

EXAMPLE 3

To each recording sheet having a porous ink-receiving layer of pseudoboehmite prepared in the same manner as in Example 1, treating solutions having various concentrations of the treating agents as identified in Table 3, was coated in the same manner as in Example 1. In this Example, thiocyanate esters or thiocyanates were used as treating agents. Evaluation was carried out in the same manner as in Example 1, and the results are shown in Table 3. Further, to the recording sheets of this Example, recording was carried out by means of an ink jet printer, whereby the ink absorptivity and the colorant-fixing property were excellent.

TABLE 3

| Treating agent | Concentration of the treating solution | Supported amount | Color fading degree |
|---|---|---|---|
| Non-treatment | 0 | 0 | X |
| Methyl thiocyanate | 0.1 | 0.08 | ○ |
| | 0.3 | 0.33 | ○ |
| | 1.0 | 1.00 | ○ |
| | 2.0 | 1.88 | ○ |
| Ethyl thiocycanate | 0.1 | 0.05 | ○ |
| | 0.3 | 0.25 | ○ |
| | 1.0 | 0.90 | ○ |
| | 2.0 | 1.68 | ○ |
| Sodium thiocyanate | 0.1 | 0.03 | Δ |
| | 0.3 | 0.35 | ○ |
| | 1.0 | 0.78 | ○ |
| | 2.0 | 1.70 | ○ |
| Potassium thiocyanate | 0.1 | 0.05 | ○ |
| | 0.3 | 0.33 | ○ |
| | 1.0 | 0.85 | ○ |
| | 2.0 | 1.70 | ○ |
| Calcium thiocyanate | 0.1 | 0.05 | ○ |
| | 0.3 | 0.28 | ○ |
| | 1.0 | 0.90 | ○ |
| | 2.0 | 1.70 | ○ |

EXAMPLE 4

Coated papers obtained by coating porous silica on paper substrates in the same manner as in Example 1, were dipped in aqueous solutions or ethanol solutions having various concentrations of the treating agents as identified in Table 4 for uniform coating. The coated papers were vertically suspended and dried in air, and then they were heated at 140° C. for 4 minutes by a drum dryer. In this Example, dithiocarbamates were used as treating agents.

With respect to the silica-coated papers thus obtained, evaluation was carried out in the same manner as in Example 1. The results are shown in Table 4. In Table 4, the unit for the concentration of the treating agent in the treating solution is weight %, and the unit for the supported amount of the treating agent in the recording sheet is mg per g of silica ($SiO_2$). The color-fading degree was evaluated by three ratings of x (considerable color-fading), Δ (slight color-fading) and ○ (little color-fading). Further, the color-fading degree of the non-treating sheet was considerable (x). The units for the concentration of the treating solution and the supported amount as well as the evaluation standards for the color fading-degree are the same also in the following Tables 5 and 6. Further, to the silica-coated papers of this Example, recording was carried out by means by an ink jet printer, whereby the ink absorptivity and the colorant-fixing property were excellent.

TABLE 4

| Treating agent | Concentration of the treating solution | Supported amount | Color fading degree |
|---|---|---|---|
| Non-treatment | 0 | 0 | X |
| Sodium | 0.1 | 0.05 | ○ |
| dimethyl | 0.3 | 0.33 | ○ |
| dithiocarba- | 1.0 | 1.05 | ○ |
| mate | 2.0 | 1.83 | ○ |
| Sodium diethyl | 0.1 | 0.08 | Δ |
| dithiocarba- | 0.3 | 0.28 | ○ |
| mate | 1.0 | 0.83 | ○ |
| | 2.0 | 1.71 | ○ |
| Potassium | 0.1 | 0.05 | ○ |
| dimethyl | 0.3 | 0.33 | ○ |
| dithiocarba- | 1.0 | 0.75 | ○ |
| mate | 2.0 | 1.70 | ○ |
| zinc dimethyl | 0.1 | 0.05 | Δ |
| dithiocarba- | 0.3 | 0.33 | ○ |
| mate | 1.0 | 0.90 | ○ |
| | 2.0 | 1.70 | ○ |

EXAMPLE 5

To silica-coated papers prepared in the same manner as in Example 4, treating solutions having various concentrations of the treating agents as identified in Table 5, were coated in the same manner as in Example 1. In this Example, thiurams were used as the treating agents. With respect to the silica-coated papers thus obtained, evaluation was carried out in the same manner as in Example 4. The results are shown in Table 5. The color-fading degree of the non-treated silica-coated papers was considerable (x). Further, to the silica-coated papers of this Example, recording was carried out by means of an ink jet printer, whereby the ink absorptivity and the colorant-fixing property were excellent.

TABLE 5

| Treating agent | Concentration of the treating solution | Supported amount | Color fading degree |
|---|---|---|---|
| Non-treatment | 0 | 0 | X |
| Tetramethyl | 0.1 | 0.08 | Δ |
| thiuram | 0.3 | 0.30 | ○ |

TABLE 5-continued

| Treating agent | Concentration of the treating solution | Supported amount | Color fading degree |
|---|---|---|---|
| disulfide | 1.0 | 1.03 | ○ |
| | 2.0 | 1.71 | ○ |
| Tetraethyl | 0.1 | 0.05 | ○ |
| thiuram | 0.3 | 0.28 | ○ |
| disulfide | 1.0 | 0.88 | ○ |
| | 2.0 | 1.88 | ○ |
| Tetrabutyl | 0.1 | 0.08 | Δ |
| thiuram | 0.3 | 0.30 | ○ |
| disulfide | 1.0 | 0.88 | ○ |
| | 2.0 | 1.73 | ○ |
| Tetramethyl | 0.1 | 0.08 | ○ |
| thiuram | 0.3 | 0.35 | ○ |
| monosulfide | 1.0 | 0.88 | ○ |
| | 2.0 | 1.63 | ○ |
| Tetraethyl | 0.1 | 0.05 | Δ |
| thiuram | 0.3 | 0.33 | ○ |
| monosulfide | 1.0 | 0.80 | ○ |
| | 2.0 | 1.63 | ○ |

EXAMPLE 6

To silica-coated papers prepared in the same manner as in Example 4, treating solutions having various concentrations of the treating agents as identified in Table 6, were coated in the same manner as in Example 1. In this Example, thiocyanate esters or thiocyanates were used as treating agents. With respect to the silica-coated papers thus obtained, evaluation was carried out in the same manner as in Example 4. The results are shown in Table 6. The color-fading degree of the non-treated silica-coated paper was considerable (x). Further, to the silica-coated papers of this Example, recording was carried out by means of an ink jet printer, whereby the ink absorptivity and the colorant-fixing property were excellent.

TABLE 6

| Treating agent | Concentration of the treating solution | Supported amount | Color fading degree |
|---|---|---|---|
| Non-treatment | 0 | 0 | X |
| Methyl | 0.1 | 0.08 | ○ |
| thiocyanate | 0.3 | 0.33 | ○ |
| | 1.0 | 1.00 | ○ |
| | 2.0 | 1.88 | ○ |
| Ethyl | 0.1 | 0.05 | Δ |
| thiocyanate | 0.3 | 0.25 | ○ |
| | 1.0 | 0.90 | ○ |
| | 2.0 | 1.68 | ○ |
| Sodium | 0.1 | 0.03 | ○ |
| thiocyanate | 0.3 | 0.35 | ○ |
| | 1.0 | 0.78 | ○ |
| | 2.0 | 1.70 | ○ |
| Potassium | 0.1 | 0.05 | ○ |
| thiocyanate | 0.3 | 0.33 | ○ |
| | 1.0 | 0.85 | ○ |
| | 2.0 | 1.70 | ○ |
| Calcium | 0.1 | 0.05 | ○ |
| thiocyanate | 0.3 | 0.28 | ○ |
| | 1.0 | 0.90 | ○ |
| | 2.0 | 1.70 | ○ |

EXAMPLE 7

The coated surfaces of recording sheets each having a porous ink-receiving layer of pseudoboehmite prepared in the same manner as in Example 1 were dipped in aqueous solutions or ethanol solutions of various concentrations of the treating agents as identified in Table 7, so that the solutions were uniformly coated. The coated sheets were vertically suspended and dried in air, and then they were heated at 140° C. for 4 minutes by a drum dryer. In the foregoing Examples 1 to 6, only one compound among dithiocarbamates, thiurams, thiocyanate esters and thiocyanates, was used. Whereas in this Example, a mixture of one compound among dithiocarbamates, thiurams and thiocyanates, and a quencher made of sodium iodide or potassium iodide, was used as the treating agent. The weight ratio of the quencher made of sodium iodide or potassium iodide to one compound among dithiocarbamates, thiurams and thiocyanates was 1:2. The concentration of the treating solution is the weight % of the total of the mixture comprising one compound among dithiocarbamates, thiurams and thiocyanates, and the quencher made of sodium iodide or potassium iodide.

The quantitative analysis of the total amount of the mixture comprising one compound among dithiocarbamates, thiurams and thiocyanates, and the quencher made of sodium iodide or potassium iodide in the porous ink-receiving layer of the recording sheet thus obtained, and evaluation of the color fading degree, were carried out in the same manner as in Example 1. The results are shown in Table 7. The unit for the supported amount and the evaluation standards for the color-fading degree were the same as in Table 1.

Further, coloring of the recording sheets was inspected visually after leaving the sheets in a room for 10 days. The results are also shown in Table 7.

Further, for the purpose of comparison, the color-fading and coloring of the recording sheet which was not treated with any agent were inspected in the same manner. The results are shown as "non-treatment" also in Table 7.

Furthermore, for the purpose of comparison, with respect to a case where only sodium iodide as a quencher was used as the treating agent, the color-fading and coloring of the recording sheet were examined in the same manner. The results are also shown in Table 7.

Further, also with respect to a case where a mixture of potassium iodide and CHIMASSORB 944 LD as a quencher, was employed as the treating agent, the color-fading and coloring of the recording sheet were examined in the same manner. The results are also shown Table 7. The weight ratio of the potassium iodide to CHIMASSORB 944 LD was 1:2. The concentration of the treating solution and the supported amount represent the concentration and the supported amount of the total of the mixture of the potassium iodide and CHIMASSORB 944 LD. Here, CHIMASSORB 944 LD is a tradename of CIBA-GEIGY, and CHIMASSORB is a registered trademark of the same company. This compound is poly[{6-(1,1,3,3-tetramethybutyl)amino-1,3,5-triazine-2,4-diyl}{(2,2,6,6-tetramethyl-4-piperydyl) imino}hexamethylene{(2,2,6,6-tetramethyl-4-piperydyl) imino}], one of hindered amine light stabilizers.

TABLE 7

| Treating agent | Concentration of the treating solution | Supported amount | Color fading degree | coloring of the sheet |
|---|---|---|---|---|
| Non-treatment | 0 | 0 | X | Nil |
| Sodium iodide | 0.2 | 0.18 | ○ | Slightly yellow |

TABLE 7-continued

| Treating agent | Concentration of the treating solution | Supported amount | Color fading degree | coloring of the sheet |
|---|---|---|---|---|
| | 0.3 | 0.28 | | Yellow |
| | 0.5 | 0.48 | ○ | Yellow |
| | 1.0 | 0.94 | ○ | Yellowish brown |
| Sodium iodide + tetramethyl-thiuram disulfide | 0.3 | 0.40 | ○ | Nil |
| | 1.0 | 1.08 | ○ | Nil |
| | 2.0 | 2.03 | ○ | Nil |
| Sodium iodide + sodium dimethyl dithiocarbamate | 0.3 | 0.25 | ○ | Nil |
| | 1.0 | 1.10 | ○ | Nil |
| | 2.0 | 1.95 | ○ | Nil |
| Sodium iodide + sodium thiocyanate | 0.3 | 0.33 | ○ | Nil |
| | 1.0 | 1.10 | ○ | Nil |
| | 2.0 | 1.93 | ○ | Nil |
| Potassium iodide + CHIMASSORB 944 LD | 0.15 | 0.20 | ○ | Nil |
| | 0.3 | 0.43 | ○ | Nil |

It is apparent from Table 7 that in the case of this Example wherein a mixture of one compound among dithiocarbamates, thiurams and dithiocyanates, and a quencher made of sodium iodide or potassium iodide, was used as the treating agent, the anti-fading property was excellent, and no coloring of the sheet was observed, whereas in the case where only sodium iodide as a quencher was used as the treating agent, the recording sheet was colored, although the anti-fading property was excellent. Further, when a mixture of potassium iodide and CHIMASSORB 944 LD as a quencher, was used as the treating agent, excellent effects were obtained even when the supported amount was small.

Further, to the recording sheets of this Example, recording was carried out by means of an ink jet printer, whereby the ink absorptivity and the colorant-fixing property were excellent.

EXAMPLE 8

The coated surfaces of recording sheets each having a porous ink receiving layer of pseudoboehmite prepared in the same manner as in Example 1 were dipped in aqueous solutions or ethanol solutions having various concentrations of the treating agents as identified in Table 8, so that the solutions were uniformly coated. The coated sheets were vertically suspended and dried in air, and then they were heated at 140° C. for 4 minutes by a drum dryer. In the foregoing Examples 1 to 6, only one compound among dithiocarbamates, thiurams, thiocyanate esters and thiocyanates, was used as the treating agent. Whereas, in this Example, a mixture of a thiuram and a thiocyanate, or a mixture of a thiocyanate and a hindered amine compound, was used as the treating agent. The weight ratio of the thiuram to the thiocyanate was 1:2, and the weight ratio of the thiocyanate to the hindered amine compound was 2:1. The concentration of the treating solution was the weight % of the total of the mixture of the thiuram and the thiocyanate, or the mixture of the thiocyanate and the hindered amine.

The quantitative analysis of the total amount of the mixture of the thiuram and the thiocyanate, or the mixture of the thiocyanate and the hindered amine, in the porous ink-receiving layer of the-recording sheet thus obtained, and the evaluation of the color-fading degree, were carried out in the same manner as in Example 1. The results are shown in Table 8. The unit for the supported amount and the evaluation standards for the color-fading degree were the same as in Table 1.

Further, for the purpose of comparison, the color-fading was examined in the same manner with respect to the recording sheet which was not treated with any agent. The results are shown as "non-treatment" in Table 8.

Here, TINUVIN 622 LD is a tradename of Ciba-geigy, and TINUVIN is a registered trademark of the same company. This compound is polycondensate of dimethyl succinate with 1-(2-hydroxyethyl)-4-hydroxy-2,2,6,6-tetramethylpiperidine, one of hindered amine light stabilizers.

TABLE 8

| Treating agent | Concentration of the treating solution | Supported amount | Color fading degree |
|---|---|---|---|
| Non-treatment | 0 | 0 | X |
| TINUVIN 622 LD + | 0.3 | 0.35 | ○ |
| sodium | 1.0 | 1.00 | ○ |
| thiocyanate | 2.0 | 1.98 | ○ |
| Tetramethyl- | 0.3 | 0.25 | ○ |
| thiuram | 1.0 | 1.03 | ○ |
| disulfide + | 2.0 | 1.93 | ○ |
| sodium thiocyanate | | | |
| Tetraethyl- | 0.3 | 0.33 | ○ |
| thiuram | 1.0 | 1.05 | ○ |
| disulfide + | 2.0 | 1.83 | ○ |
| sodium thiocyanate | | | |
| CHIMASSORB 944 | 0.3 | 0.38 | ○ |
| LD + sodium | 1.0 | 1.18 | ○ |
| thiocyanate | 2.0 | 1.98 | ○ |

It is apparent from Table 8 that excellent anti-fading properties are obtainable not only in a case where a mixture of a thiuram and a thiocyanate is used as the treating agent but also in a case where a mixture of a thiocyanate and a hindered amine, is used as the treating agent.

Further, to the recording sheets of this Example, recording was carried out by means of an ink jet printer, whereby the ink absorptivity and the colorant-fixing property were excellent.

EXAMPLE 9

The coated surfaces of recording sheets each having an ink-receiving layer of pseudoboehmite prepared in the same manner as in Example 1, were dipped in aqueous solutions or ethanol solutions having various concentrations of the treating agents as identified in Table 9, so that the solutions were uniformly coated. They were vertically suspended and dried in air, and then they were heated at 140° C. for 4 minutes by a drum dryer. The ratio of the respective compounds in Table 9 is weight ratio. The concentration of the treating solution is weight % of the total of the compounds. The supported amount and the color-fading degree were evaluated in the same manner as in Example 1.

TABLE 9

| Treating agent | Concentration of the treating solution | Supported amount | Color fading degree |
|---|---|---|---|
| Non-treatment | 0 | 0 | X |
| Thiourea + | 0.2 | 0.24 | Δ |
| potassium iodide + | 0.5 | 0.58 | ○ |
| sodium | 1.0 | 1.28 | ○ |
| thiocyanate | 2.0 | 2.24 | ○ |
| (3:1:3) | | | |
| Thiourea + | 0.2 | 0.23 | Δ |
| potassium | 0.5 | 0.64 | ○ |
| thiocyanate | 1.0 | 1.19 | ○ |
| (1:2) | 2.0 | 2.18 | ○ |
| Thiosemicarba- | 0.2 | 0.21 | Δ |
| zide + potassium | 0.5 | 0.474 | ○ |
| iodide + | 1.0 | 1.18 | ○ |
| potassium thiocyanate | 2.0 | 2.22 | ○ |
| (3:1:3) | | | |
| Thiosemicarba- | 0.2 | 0.22 | Δ |
| zide + potassium | 0.5 | 0.55 | ○ |
| thiocyanate | 1.0 | 1.18 | ○ |
| (1:2) | 2.0 | 2.20 | ○ |
| Tiocarbohydra- | 0.2 | 0.23 | Δ |
| zide + potassium | 0.5 | 0.57 | ○ |
| thiocyanate | 1.0 | 1.20 | ○ |
| (1:1) | 2.0 | 2.21 | ○ |
| Tiocarbohydra- | 0.2 | 00.25 | Δ |
| zide + potassium | 0.5 | 0.56 | ○ |
| iodide + sodium | 1.0 | 1.18 | ○ |
| thiocyanate | 2.0 | 2.29 | ○ |
| (3:1:3) | | | |

I claim:

1. A recording sheet which comprises a substrate and a porous ink-receiving layer containing uniformly distributed therein at least one compound selected from the group consisting of sodium thiocyanate, potassium thiocyanate and calcium thiocyanate, formed on the substrate.

2. The recording sheet according to claim 1, wherein the porous ink-receiving layer further contains a quencher made of iodine or an iodide.

3. The recording sheet according to claim 1, wherein the porous ink-receiving layer further contains at least one compound selected from the group consisting of thioureas, thiosemicarbazides and thiosemicarbazides.

4. The recording sheet according to claim 1, wherein the porous ink-receiving layer is a layer made of pseudoboehmite.

5. The recording sheet according to claim 1, which is a recording medium for an ink jet printer.

6. The recording sheet according to claim 1, wherein said compound is sodium thiocyanate.

7. The recording sheet according to claim 1, wherein said compound is potassium thiocyanate.

8. A record which comprises a substrate and a porous ink-receiving layer containing uniformly distributed therein at least one compound selected from the group consisting of sodium thiocyanate, potassium thiocyanate and calcium thiocyanate, formed on the substrate, wherein colorants are supported in the porous ink-receiving layer.

9. The record according to claim 8, wherein the porous ink-receiving layer further contains a quencher made of iodine or an iodide.

10. The record according to claim 8, wherein the porous ink-receiving layer further contains at least one compound selected from the group consisting of thioureas, thiosemicarbazides and thiosemicarbazides.

11. The record according to claim 8, wherein the porous ink-receiving layer is a layer made of pseudoboehmite.

12. The record according to claim 8, wherein said compound is sodium thiocyanate.

13. The record according to claim 8, wherein said compound is potassium thiocyanate.

14. A recording sheet which comprises a substrate and a porous ink-receiving layer containing uniformly distributed therein at least one compound selected from the group consisting of sodium thiocyanate, potassium thiocyanate and calcium thiocyanate, and further containing as a quencher potassium iodide or sodium iodide, formed on the substrate.

15. The recording sheet according to claim 14, wherein the porous ink-receiving layer further contains at least one compound selected from the group consisting of thioureas, thiosemicarbazides and thiocarbohydrazides.

16. The recording sheet according to claim 14, wherein the porous ink-receiving layer is a layer made of pseudoboehmite.

17. The recording sheet according to claim 14, which is a recording medium for an ink jet printer.

18. A record which comprises a substrate and a porous ink-receiving layer containing uniformly distributed therein at least one compound selected from the group consisting of sodium thiocyanate, potassium thiocyanate and calcium thiocyanate, formed on the substrate, and further containing as a quencher potassium iodide or sodium iodide, and wherein colorants are supported in the porous ink-receiving layer.

19. The record according to claim 18, wherein the porous ink-receiving layer further contains at least one compound selected from the group consisting of thioureas, thiosemicarbazides and thiocarbohydrazides.

20. The record according to claim 18, wherein the porous ink-receiving layer is a layer made of pseudoboehmite.

* * * * *